US008618902B2

(12) United States Patent
Nogi et al.

(10) Patent No.: US 8,618,902 B2
(45) Date of Patent: Dec. 31, 2013

(54) LAMINATED INDUCTOR

(75) Inventors: Kenichirou Nogi, Gunma (JP); Masanori Nagano, Gunma (JP); Mayumi Hoshino, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/642,472

(22) PCT Filed: Apr. 18, 2011

(86) PCT No.: PCT/JP2011/059483

§ 371 (c)(1), (2), (4) Date: Nov. 29, 2012

(87) PCT Pub. No.: WO2011/132626

PCT Pub. Date: Oct. 27, 2011

(65) Prior Publication Data

US 2013/0214888 A1 Aug. 22, 2013

(30) Foreign Application Priority Data

Apr. 21, 2010 (JP) ..... 2010-098160

(51) Int. Cl.

| | |
|---|---|
| ***H01F 27/28*** | (2006.01) |
| ***H01F 27/29*** | (2006.01) |
| ***H01F 5/00*** | (2006.01) |
| ***H01F 27/24*** | (2006.01) |

(52) U.S. Cl.

USPC ..... 336/223; 336/192; 336/200; 336/234

(58) Field of Classification Search

USPC ..... 336/200, 223, 233, 234, 192, 83

See application file for complete search history.

(56) References Cited

U.S. PATENT DOCUMENTS

| | | | | |
|---|---|---|---|---|
| 5,032,815 | A * | 7/1991 | Kobayashi et al. | 336/83 |
| 5,977,845 | A * | 11/1999 | Kitahara | 333/184 |
| 6,437,677 | B1 * | 8/2002 | Takeuchi et al. | 336/200 |
| 6,515,561 | B2 | 2/2003 | Tamura et al. | |
| 6,675,462 | B1 | 1/2004 | Takahashi | |
| 2006/0249810 | A1 * | 11/2006 | Lee et al. | 257/531 |

FOREIGN PATENT DOCUMENTS

| | | | |
|---|---|---|---|
| JP | H04-105511 | U | 9/1992 |
| JP | 1993-66920 | U | 9/1993 |
| JP | H11-317308 | A1 | 11/1999 |
| JP | 2000-348939 | A1 | 12/2000 |
| JP | 2001-044037 | A1 | 2/2001 |
| JP | 2007-012920 | A | 1/2007 |

* cited by examiner

*Primary Examiner* — Alexander Talpalatski
*Assistant Examiner* — Mangtin Lian
(74) *Attorney, Agent, or Firm* — Law Office of Katsuhiro Arai

(57) ABSTRACT

A laminated inductor, which offers high inductance while suppressing increase in direct-current resistance, has a rectangular solid laminate and a pair of terminal electrodes formed only on the bottom face of the laminate, wherein a folded conductor piece is provided on the first magnetic layer in a manner constituting around one turn worth of the windings, with one end placed near the first corner and the other end placed at a position toward the center and away from this one end so as not to overlap with the one end, while one of multiple sets of coil conductor pieces, each set constituting around one turn worth of the windings, is placed on multiple magnetic layers in the laminate.

5 Claims, 7 Drawing Sheets

LAMINATED INDUCTOR

This application is the U.S. National Phase under 35 U.S.C. §371 of International Application PCT/JP2011/059483, filed Apr. 18, 2011, which claims priority to Japanese Patent Application No. 2010-098160, filed Apr. 21, 2010. The International Application was published under PCT Article 21(2) in a language other than English.

TECHNICAL FIELD

The present invention relates to a laminated inductor used as a choke coil in a power-supply circuit, etc., of an electronic device.

RELATED ART

With the growing needs for portable electronic devices and slim electronic devices, the number of such electronic devices is increasing that use a laminated inductor as a choke coil in their power-supply circuit, etc. One example of such laminated inductor is disclosed in Patent Literature 1, which is a laminated inductor constituted by a coil conductor placed in a laminate made of a magnetic material, etc., wherein one end and the other end of the coil conductor are connected to a pair of terminal electrodes formed on a pair of opposing end faces of the laminate. FIG. 13 is an oblique perspective view of the internal structure of a part of a laminate of a laminated inductor, while FIG. 14 is an exploded perspective view of the laminate.

As shown in FIG. 13, a laminated inductor 110 has: a rectangular solid laminate 111 made of a magnetic material, etc.; a coil conductor 114 placed in the laminate 111; and a pair of terminal electrodes 115*a*, 115*b* formed on a pair of opposing end faces, as well as on a top face, bottom face and both side faces contacting the end faces, of the laminate 111. As shown in FIG. 14, the laminate 111 has multiple magnetic layers 112*a*, 112*b*, 112*c*, with multiple coil conductor pieces 114*b*1, 114*b*2, 114*b*3, 114*b*4, 114*b*5, 114*b*6 placed between these multiple magnetic layers. The magnetic layers 112*b*1, 112*b*2, 112*b*3, 112*b*4, 112*b*5 have through holes 112*d*1, 112*d*2, 112*d*3, 112*d*4, 112*d*5 formed in them that connect the front side and back side of each magnetic layer, and each of these through holes has a through hole conductor 114*d*1, 114*d*2, 114*d*3, 114*d*4 or 114*d*5 (not illustrated) placed in them. The coil conductor 114 is formed in a manner spiraling in the height direction, with the coil conductor pieces 114*b*1, 114*b*2, 114*b*3, 114*b*4, 114*b*5, 114*b*6 placed adjacent to each other via the through hole conductors 114*d*1, 114*d*2, 114*d*3, 114*d*4, 114*d*5 placed on the magnetic layer 112*b* and electrically connected to each other. The coil conductor piece 114*b*1 in the top layer has a leader part 114*e*1 on one end of the conductor piece of around one turn, while the other end is electrically connected to one end of the adjacent coil conductor piece 114*b*2 in the stacking direction via the through hole conductor 114*d*1. The coil conductor piece 114*b*2 is placed in a position away from the outer side of the windings so that the other end of the conductor piece of around one turn does not overlap with one end of the coil conductor piece 114*b*2, and electrically connected to one end of the adjacent coil conductor piece 114*b*3 in the stacking direction via the through hole conductor 114*d*2. The coil conductor piece 114*b*3 is placed in a position away from the outer side of the windings so that one end of the conductor piece of around one turn does not overlap with the other end of the coil conductor piece, with the other end of the coil conductor piece 114*b*3 electrically connected to one end of the adjacent coil conductor piece 114*b*4 in the stacking direction via the through hole conductor 114*d*3. The coil conductor piece 114*b*4 is formed in the same shape as the coil conductor piece 114*b*2, placed in a position away from the outer side of the windings so that the other end of the conductor piece of around one turn does not overlap with one end of the coil conductor piece, and electrically connected to one end of the adjacent coil conductor piece 114*b*5 in the stacking direction via the through hole conductor 114*d*4.

The coil conductor piece 114*b*5 is formed in the same shape as the coil conductor piece 114*b*3, placed in a position away from the outer side of the windings so that one end of the conductor piece of around one turn does not overlap with the other end of the coil conductor piece 114*b*5, and the other end of the coil conductor piece is electrically connected to one end of the adjacent coil conductor piece 114*b*6 in the stacking direction via the through hole conductor 114*d*5. The coil conductor piece 114*b*6 has a leader part 114*e*2 on the other end of the conductor piece of around half a turn. The leader part 114*e*1 of the coil conductor piece 114*b*1 and leader part 114*e*2 of the coil conductor piece 114*b*6 are exposed to the pair of opposing end faces of the laminate 111, respectively, and electrically connected to the pair of terminal electrodes 115*a*, 115*b*, respectively. The aforementioned laminated inductor 110 is characterized in that, because it has the coil conductor pieces 114*b*1, 114*b*2, 114*b*3, 114*b*4, 114*b*5 of around one turn, the number of layers can be reduced compared to other laminated inductors that use only coil conductor pieces of half a turn or coil conductor pieces of three quarters of a turn.

PRIOR ART LITERATURE

Patent Literature

Patent Literature 1: Japanese Utility Model Laid-open No. Hei 4-105511

SUMMARY OF THE INVENTION

Problems to be Solved by the Invention

The conventional laminated inductor mentioned above has terminal electrodes 115*a*, 115*b* formed on the top face, and end face and both side faces contacting the top face, of the laminate 111 and therefore an attempt to mount the inductor in a metal shield of an electronic device as a countermeasure to noise makes it necessary to limit the height dimension more to prevent short-circuiting of the terminal electrodes and metal shield, which in turn makes it difficult to obtain high inductance. Also with the conventional laminated inductor mentioned above, eddy current loss tends to occur at the terminal electrodes as the pair of terminal electrodes 115*a*, 115*b* approach the spiral coil conductor 114 placed in the laminate 111, which makes it difficult to increase the cross-section area of the magnetic path on the inside of the coil conductor 114. To obtain high inductance, therefore, the number of windings of the coil conductor must be increased, which gives rise to undesirable outcomes such as a higher direct-current resistance of the coil conductor or need to increase the height dimension.

An object of the present invention is to solve the aforementioned problems of the conventional laminated inductor by providing a laminated inductor that can be easily mounted in a metal shield of an electronic device, and provides high inductance while suppressing increase in direct-current resistance.

Means for Solving the Problems

The present invention is a laminated inductor used as a choke coil in a power-supply circuit, etc., of an electronic device, wherein (1) the laminated inductor comprises:

a rectangular solid laminate constituted by multiple rectangular magnetic layers stacked in the thickness direction;

a pair of terminal electrodes formed at least on the bottom face of the laminate excluding the top face, and areas near the top face on the end face and both side faces contacting the top face, of the laminate;

a folded conductor piece placed on a first magnetic layer inserted into the laminate near the top face;

multiple sets of coil conductor pieces where each set is placed on the multiple magnetic layers between the first magnetic layer in the laminate and bottom face of the laminate, with the total of each set constituting around one turn worth of the windings; and multiple through hole conductors, each penetrating through at least one magnetic layer in the laminate and interconnecting the conductor pieces lying adjacently on both sides of this magnetic layer;

wherein such laminated inductor is characterized in that:

the folded conductor piece constitutes around one turn worth of the windings along each side of the first magnetic layer, and has one end placed near any first corner of the first magnetic layer, and the other end placed at a position on the first rectangular magnetic layer which is near the first corner but toward the center and away from the aforementioned one end so as not to overlap with the one end;

among the multiple sets of coil conductor pieces, the coil conductor pieces in the first set closest to the folded conductor piece comprise: a first coil conductor piece having a first end connected to the one end of the folded conductor piece via a first through hole conductor among the multiple through hole conductors placed near the first corner of the laminate, and a second end placed near any second corner among the remaining three corners of the laminate; and a second coil conductor piece having a third end connected to the other end of the folded conductor piece via a second through hole conductor among the multiple through hole conductors placed at a position on the rectangular magnetic layer which is near the first corner of the laminate but toward the center and away from the first end, and a fourth end placed near the second corner;

any one of the second end of the first coil conductor piece and fourth end of the second coil conductor piece is placed at a position on the rectangular magnetic layer which is near the second corner but toward the center and away from the end of the other coil conductor piece; and among the multiple sets of coil conductor pieces, the set of coil conductor pieces closest to the bottom face is connected to the pair of terminal electrodes via through hole conductors and/or other coil conductor pieces, respectively. (The above is hereinafter referred to as the first technical means of the present invention.)

Another key embodiment of the aforementioned laminated inductor is characterized in that (2) the cross-section area of the magnetic path on the inner side of the folded conductor piece is greater than the cross-section area of the magnetic path on the inner side of the first set of coil conductor pieces closest to the folded conductor piece among the multiple sets of coil conductor pieces. (The above is hereinafter referred to as the second technical means of the present invention.)

Another key embodiment of the aforementioned laminated inductor is characterized in that (3) the second corner of the laminate is positioned diagonally opposite the first corner. (The above is hereinafter referred to as the third technical means of the present invention.)

Another key embodiment of the aforementioned laminated inductor is characterized in that (4) the first terminal electrode electrically connected via a coil conductor piece to the one end of the folded conductor piece, and second terminal electrode electrically connected via a coil conductor piece to the other end of the folded conductor piece, are each formed only on the bottom face of the laminate. (The above is hereinafter referred to as the fourth technical means of the present invention.)

Another key embodiment of the aforementioned laminated inductor is characterized in that (5) the first terminal electrode and second terminal electrode each have a wraparound part covering parts of both side faces and one end face contacting the bottom face of the laminate.

The operation of the aforementioned first technical means is as follows. To be specific, there is no need to form terminal electrodes on the top face of the laminate because the present invention comprises:

a rectangular solid laminate constituted by multiple rectangular magnetic layers stacked in the thickness direction;

a pair of terminal electrodes formed at least on the bottom face of the laminate excluding the top face, and areas near the top face on the end face and both side faces contacting the top face, of the laminate;

a folded conductor piece placed on a first magnetic layer inserted into the laminate near the top face;

multiple sets of coil conductor pieces where each set is placed on the multiple magnetic layers between the first magnetic layer in the laminate and bottom face of the laminate, with the total of each set constituting around one turn worth of the windings; and multiple through hole conductors, each penetrating through at least one magnetic layer in the laminate and interconnecting the conductor pieces lying adjacently on both sides of this magnetic layer.

In addition, increase in the conductor length at the intersecting zone between the coil conductor connected to the one end of the folded conductor piece and coil conductor connected to the other end of the folded conductor piece is suppressed because:

the folded conductor piece constitutes around one turn worth of the windings along each side of the first magnetic layer, and has one end placed near any first corner of the first magnetic layer, and the other end placed at a position on the first rectangular magnetic layer which is near the first corner but toward the center and away from the aforementioned one end so as not to overlap with the one end;

among the multiple sets of coil conductor pieces, the coil conductor pieces in the first set closest to the folded conductor piece comprise: a first coil conductor piece having a first end connected to the one end of the folded conductor piece via a first through hole conductor among the multiple through hole conductors placed near the first corner of the laminate, and a second end placed near any second corner among the remaining three corners of the laminate; and a second coil conductor piece having a third end connected to the other end of the folded conductor piece via a second through hole conductor among the multiple through hole conductors placed at a position on the rectangular magnetic layer which is near the first corner of the laminate but toward the center and away from the first end, and a fourth end placed near the second corner;

any one of the second end of the first coil conductor piece and fourth end of the second coil conductor piece is placed at a position on the rectangular magnetic layer which is near the second corner but toward the center and away from the end of the other coil conductor piece; and among the multiple sets of coil conductor pieces, the set of coil conductor pieces closest to the bottom face is connected to the pair of terminal electrodes via through hole conductors and/or other coil conductor pieces, respectively.

The operation of the aforementioned second technical means is as follows. To be specific, since the cross-section area of the magnetic path on the inner side of the folded conductor piece is greater than the cross-section area of the magnetic path on the inner side of the first set of coil conductor pieces closest to the folded conductor piece among the multiple sets of coil conductor pieces, the magnetic flux that generates when current is applied to the coil conductor at the top of the laminate away from the terminal electrodes travels to near the outer periphery of the laminate and consequently a laminated inductor with high inductance can be provided.

The operation of the aforementioned third technical means is as follows. To be specific, a laminated inductor that can be manufactured easily and requires no directionality when mounting can be provided because the second corner of the laminate is positioned diagonally opposite the first corner.

The operation of the aforementioned fourth technical means is as follows. To be specific, because the first terminal electrode electrically connected via a coil conductor to the one end of the folded conductor piece, and second terminal electrode electrically connected via a coil conductor to the other end of the folded conductor piece, are each formed only on the bottom face of the laminate, the straight distance between the folded conductor piece and terminal electrodes can be made greater and consequently a high-inductance laminated inductor effectively utilizing the magnetic material at the top of the laminate can be provided.

The operation of the aforementioned fifth technical means is as follows. To be specific, a slim laminated inductor offering high mounting strength can be provided because the first terminal electrode and second terminal electrode each have a wraparound part covering parts of both side faces and one end face contacting the bottom face of the laminate.

Effects of the Invention

According to the present invention, a laminated inductor that can be easily mounted in a metal shield of an electronic device can be provided because terminal electrodes need not be formed on the top face of the laminate. Also, a laminated inductor of low direct-current resistance and high inductance can be provided because increase in the conductor length at the intersecting zone between the coil conductor connected to one end of the folded conductor piece and coil conductor connected to the other end of the folded conductor piece is suppressed.

MODE FOR CARRYING OUT THE INVENTION

Figure 1:
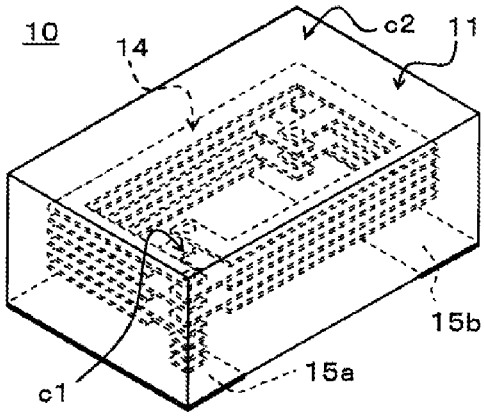
FIG. 1 is an oblique perspective view showing the internal structure of the first embodiment of the laminated inductor proposed by the present invention.
Figure 2:
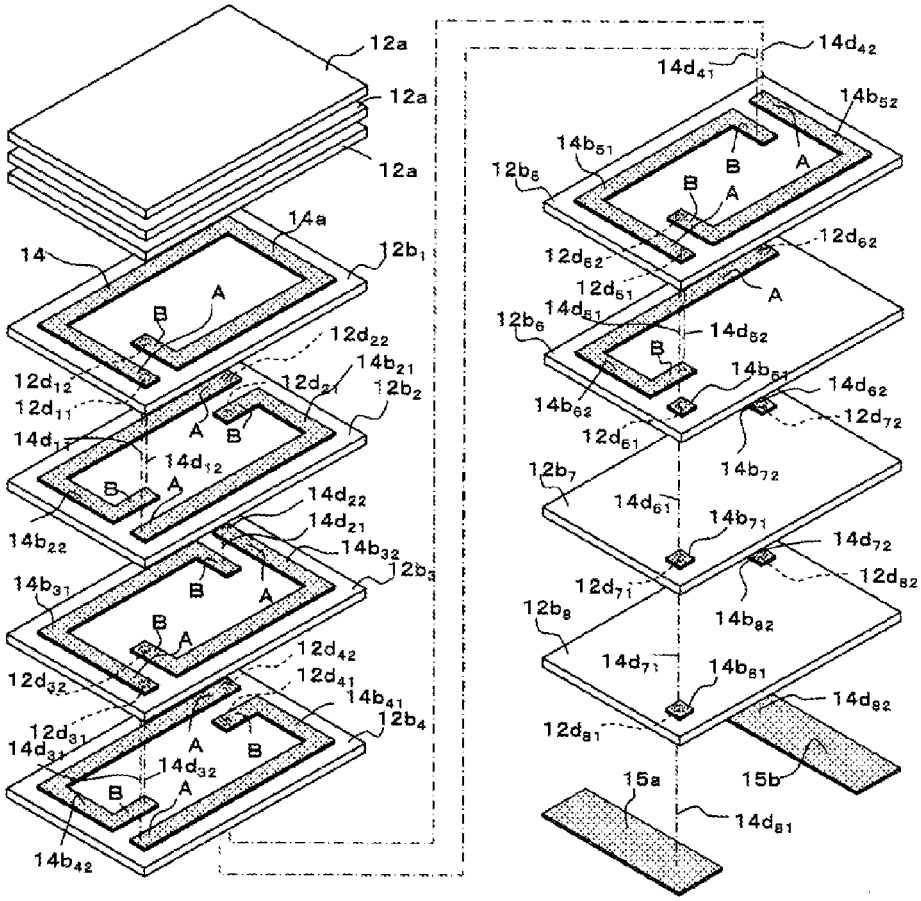
FIG. 2 is an exploded perspective view showing the internal structure of the laminated inductor according to the aforementioned embodiment.
Figure 3:
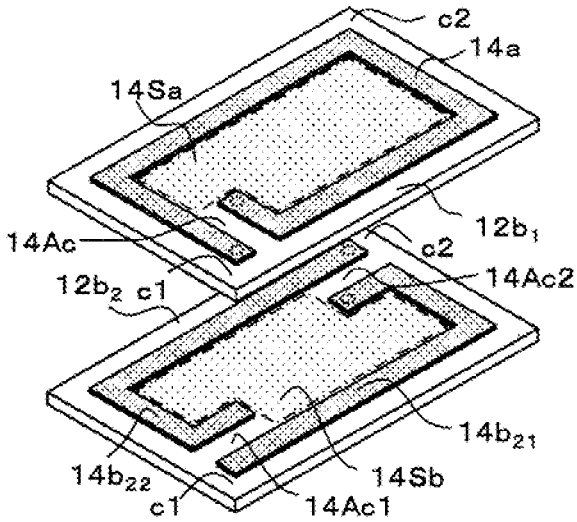
FIG. 3 is an exploded perspective view showing key parts, provided to explain the internal structure of the laminated inductor according to the aforementioned embodiment.

Next, the first embodiment of the laminated inductor proposed by the present invention is explained by referring to FIGS. 1 to 3. FIG. 1 is an oblique perspective view showing the internal structure of a laminated inductor 10 according to this embodiment. FIG. 2 is an exploded perspective view, provided to explain the internal structure of the laminated inductor 10. FIG. 3 is an exploded perspective view of key parts, provided to explain the internal structure of the laminated inductor 10.

The laminated inductor 10 according to this embodiment has:

a rectangular solid laminate 11 constituted by multiple rectangular magnetic layers 12*a*, 12*b* stacked in the thickness direction; and a pair of terminal electrodes 15*a*, 15*b* formed only on the bottom face of the laminate 11 excluding the top face, and areas near the top face on the end face and both side faces contacting the top face, of the laminate 11.

Also, a folded conductor piece 14*a* is placed on a first magnetic layer 12*b*1 inserted into the laminate 11 near the top face.

Also, one of multiple sets of coil conductor pieces 14*b*21, 14*b*22; 14*b*31, 14*b*32; 14*b*41, 14*b*42; 14*b*51, 14*b*52 is placed on multiple magnetic layers 12*b*2, 12*b*3, 12*b*4, 12*b*5 between the first magnetic layer 12*b*1 in the laminate 11 and bottom face of the laminate 11, with the total of each set constituting around one turn worth of the rectangular windings.

There are multiple through hole conductors 14*d*11, 14*d*12; 14*d*21, 14*d*22; 14*d*31, 14*d*32; 14*d*41, 14*d*42, each penetrating through at least one magnetic layer 12*b*1, 12*b*2, 12*b*3 or 12*b*4 in the laminate 11 and interconnecting the conductor pieces lying adjacently on both sides of this magnetic layer.

The folded conductor piece 14*a* constitutes around one turn worth of the rectangular windings along each side of the first magnetic layer 12b1, and has one end 14aA placed near any first corner c1 of the first magnetic layer 12b1, and the other end 14aB placed, in a bent manner, at a position on the first rectangular magnetic layer 12b1 which is near the first corner c1 but toward the center and away from the aforementioned one end 14aA so as not to overlap with the one end.

Also, among the multiple sets of coil conductor pieces 14b21, 14b22; 14b31, 14b32; 14b41, 14b42; 14b51, 14b52, the coil conductor pieces 14b21, 14b22 in the first set closest to the folded conductor piece are formed on the rectangular magnetic layer 12b2. The first coil conductor piece 14b21 has a first end 14b21A connected to the one end 14aA of the folded conductor piece 14a via the first through hole conductor 14d11 among the multiple through hole conductors placed near the first corner c1 of the laminate 11, and a second end 14b21B placed near any second corner c2 among the remaining three corners of the laminate 11. The second coil conductor piece 14b22 has a third end 14b22B connected to the other end 14aB of the folded conductor piece 14a via the second through hole conductor 14d12 among the multiple through hole conductors placed near the first corner c1 of the laminate 11, and a fourth end 14b22A placed near the second corner c2.

The second end 14b21B of the first coil conductor piece 14b21 is placed, in a bent manner, at a position on the rectangular magnetic layer 12b2 which is near the second corner c2 but toward the center and away from the fourth end 14b22A of the second coil conductor piece 14b22. The third end 14b22B of the second coil conductor piece 14b22 is placed, in a bent manner, at a position on the rectangular magnetic layer 12b2 which is near the first corner c1 but toward the center and away from the first end 14b21A of the first coil conductor piece 14b21.

Similarly, the second set of coil conductor pieces 14b31, 14b32 near the folded conductor piece is formed on the rectangular magnetic layer 12b3. The second coil conductor piece 14b32 has a first end 14b32A connected to the fourth end 14b22A of the second coil conductor piece 14b22 among the first set of coil conductor pieces via the through hole conductor 14d22 placed near the second corner c2 of the laminate 11, and a second end 14b32B placed near the first corner c1 among the remaining three corners of the laminate 11. The first coil conductor piece 14b31 has a third end 14b31B connected to the second end 14b21B of the first coil conductor piece 14b21 among the first set of coil conductor pieces via the through hole conductor 14d21 placed near the second corner c2 of the laminate 11, and a fourth end 14b31A placed near the first corner c1.

The second end 14b32B of the second coil conductor piece 14b32 is placed, in a bent manner, at a position on the rectangular magnetic layer 12b3 which is near the first corner c1 but toward the center and away from the fourth end 14b31A of the first coil conductor piece 14b31. The third end 14b31B of the first coil conductor piece 14b31 is placed, in a bent manner, at a position on the rectangular magnetic layer 12b3 which is near the second corner c2 but away toward the center from the first end 14b32A of the second coil conductor piece 14b32. The remaining multiple sets of coil conductor pieces are also connected sequentially via through hole conductors in the same manner as explained above.

Also, among the multiple sets of coil conductor pieces, the set of coil conductor pieces closest to the bottom face 14b51, 14b52 is connected to the pair of terminal electrodes 15a, 15b, respectively, via the through hole conductors 14d51, 14d52, 14d61, 14d62, 14d71, 14d72, 14d81, 14d82 and other coil conductor pieces 14b61, 14b62, 14b71, 14b72, 14b81, 14b82.

Also under this embodiment, a cross-section area 14Sa of the magnetic path on the inner side of the folded conductor piece 14a is greater than a cross-section area 14Sb of the magnetic path on the inner side of the first set of coil conductor pieces closest to the folded conductor piece among the multiple sets of coil conductor pieces so as to provide high inductance, while increase in the conductor length of the folded conductor piece 14a is suppressed compared to the total conductor length of the first set of coil conductor pieces, and consequently a laminated inductor of low direct-current resistance (Rdc) and low power consumption can be provided.

Also under this embodiment, the first coil conductor piece and second coil conductor piece in the multiple sets of coil conductor pieces have their one end placed near a corner of the laminate, and the other end placed, in a bent manner, at a position on the magnetic layer which is near another corner of the laminate but toward the center and away from the end of the other coil conductor piece. This constitution reduces the bent part needed to keep the through hole conductor on the other end away from the through hole conductor on one end, and consequently the corresponding increase in conductor length can be suppressed. This way, a laminated inductor of low direct-current resistance (Rdc) and low power consumption can be provided. Also under this embodiment, the first corner c1 of the laminate is positioned diagonally opposite the second corner c2. Under this embodiment, the first coil conductor piece and second coil conductor piece in each set can have the same shape, to provide a laminated inductor that can be produced easily and requires less directionality when mounting.

Also under this embodiment, the straight distance between the first through hole conductor and second through hole conductor can be increased, so a highly reliable laminated inductor can be provided by preventing short-circuiting between through hole conductors.

Figure 4:
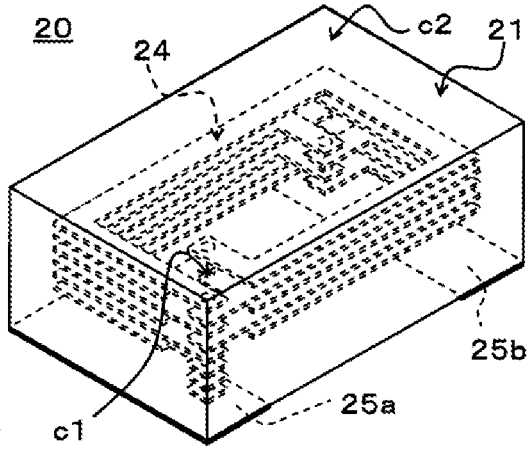
FIG. 4 is an oblique perspective view showing the internal structure of the second embodiment of the laminated inductor proposed by the present invention.
Figure 5:
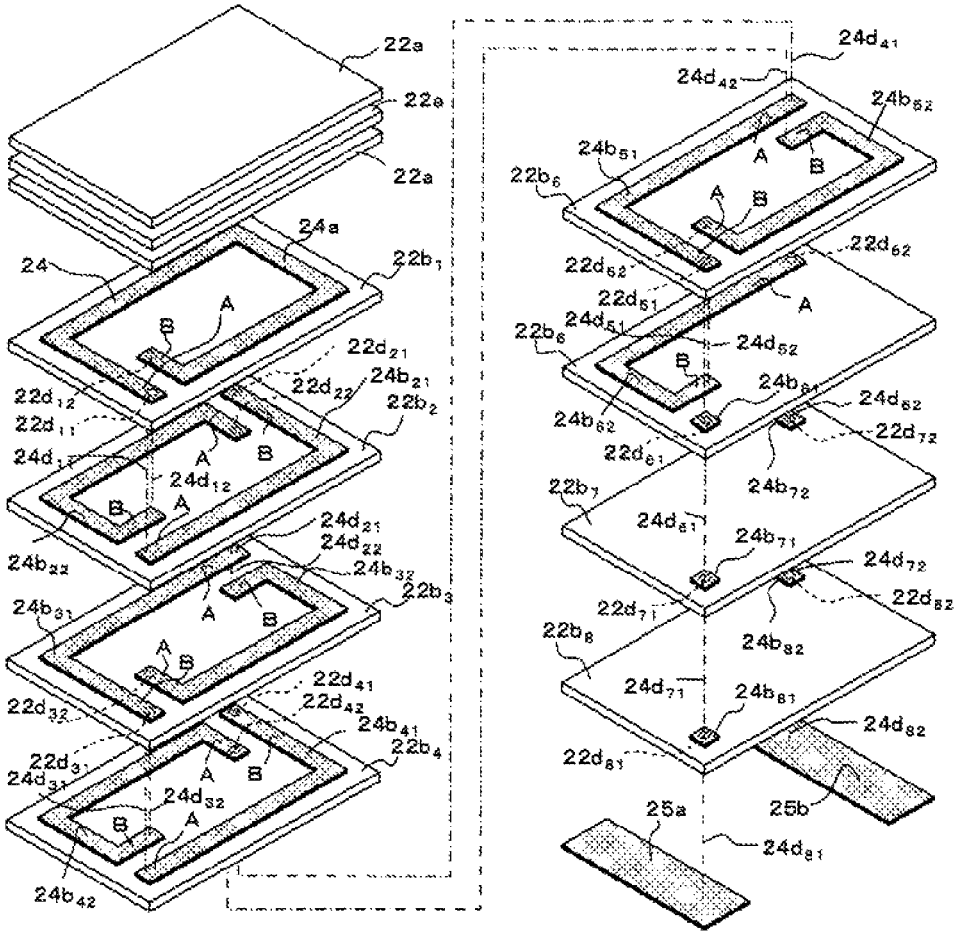
FIG. 5 is an exploded perspective view showing the internal structure of the laminated inductor according to the aforementioned embodiment.
Figure 6:
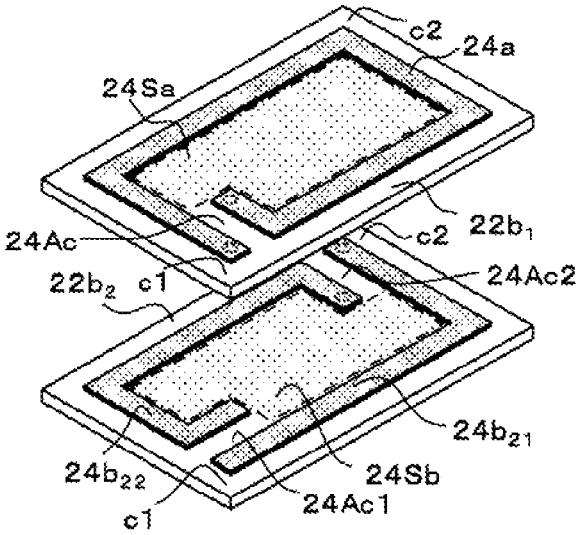
FIG. 6 is an exploded perspective view showing key parts, provided to explain the internal structure of the laminated inductor according to the aforementioned embodiment.

Next, the second embodiment of the laminated inductor proposed by the present invention is explained by referring to FIGS. 4 to 6. FIG. 4 is an oblique perspective view showing the internal structure of a laminated inductor 20 according to this embodiment. FIG. 5 is an exploded perspective view, provided to explain the internal structure of the laminated inductor 20. FIG. 6 is an exploded perspective view of key parts, provided to explain the internal structure of the laminated inductor 20.

The laminated inductor 20 according to this embodiment has:

a rectangular solid laminate 21 constituted by multiple rectangular magnetic layers 22a, 22b stacked in the thickness direction; and a pair of terminal electrodes 25a, 25b formed only on the bottom face of the laminate 21 excluding the top face, and areas near the top face on the end face and both side faces contacting the top face, of the laminate 21.

Also, a folded conductor piece 24a is placed on a first magnetic layer 22b1 inserted into the laminate 21 near the top face.

One of multiple sets of coil conductor pieces 24b21, 24b22; 24b31, 24b32; 24b41, 24b42; 24b51, 24b52 is placed on multiple magnetic layers 22b2, 22b3, 22b4, 22b5 between the first magnetic layer 22b1 in the laminate 21 and bottom face of the laminate 21, with the total of each set constituting around one turn worth of the rectangular windings.

Also, there are multiple through hole conductors 24d11, 24d12; 24d21, 24d22; 24d31, 24d32; 24d41, 24d42, each penetrating through at least one magnetic layer 22b1, 22b2, 22*b*3 or 22*b*4 in the laminate 21 and interconnecting the conductor pieces lying adjacently on both sides of this magnetic layer.

The folded conductor piece 24*a* constitutes around one turn worth of the rectangular windings along each side of the first magnetic layer 22*b*1, and has one end 24*a*A placed near any first corner c1 of the first magnetic layer 22*b*1, and the other end 24*a*B placed, in a bent manner, at a position on the first rectangular magnetic layer 22*b*1 which is near the first corner c1 but toward the center and away from the aforementioned one end 24*a*A so as not to overlap with the one end.

Also, among the multiple sets of coil conductor pieces 24*b*21, 24*b*22; 24*b*31, 24*b*32; 24*b*41, 24*b*42; 24*b*51, 24*b*52, the coil conductor pieces 24*b*21, 24*b*22 in the first set closest to the folded conductor piece are formed on the rectangular magnetic layer 22*b*2. The first coil conductor piece 24*b*21 has a first end 24*b*21A connected to the one end 24*a*A of the folded conductor piece 24*a* via the first through hole conductor 24*d*11 among the multiple through hole conductors placed near the first corner c1 of the laminate 21, and a second end 24*b*21B placed near any second corner c2 among the remaining three corners of the laminate 21. The second coil conductor piece 24*b*22 has a third end 24*b*22B connected to the other end 24*a*B of the folded conductor piece 24*a* via the second through hole conductor 24*d*12 among the multiple through hole conductors placed near the first corner c1 of the laminate 21, and a fourth end 24*b*22A placed near the second corner c2.

The fourth end 24*b*22A of the second coil conductor piece 24*b*22 is placed, in a bent manner, at a position on the rectangular magnetic layer 22*b*2 which is near the second corner c2 but toward the center and away from the second end 24*b*21B of the first coil conductor piece 24*b*21. The third end 24*b*22B of the second coil conductor piece 24*b*22 is placed, in a bent manner, at a position on the rectangular magnetic layer 22*b*2 which is near the first corner c1 but toward the center and away from the first end 24*b*21A of the first coil conductor piece 24*b*21.

Similarly, the second set of coil conductor pieces 24*b*31, 24*b*32 near the folded conductor piece is formed on the rectangular magnetic layer 22*b*3. The first coil conductor piece 24*b*31 has a first end 24*b*31A connected to the second end 24*b*21B of the first coil conductor piece 24*b*21 among the first set of coil conductor pieces via the through hole conductor 24*d*21 placed near the second corner c2 of the laminate 21, and a second end 24*b*31B placed near the first corner c1 among the remaining three corners of the laminate 21. The second coil conductor piece 24*b*32 has a third end 24*b*32B connected to the fourth end 24*b*22A of the second coil conductor piece 24*b*22 among the first set of coil conductor pieces via the through hole conductor 24*d*22 placed near the second corner c2 of the laminate 21, and a fourth end 24*b*32A placed near the first corner c1.

The fourth end 24*b*32A of the second coil conductor piece 24*b*32 is placed, in a bent manner, at a position on the rectangular magnetic layer 22*b*3 which is near the first corner c1 but toward the center and away from the second end 24*b*31B of the first coil conductor piece 24*b*31. The third end 24*b*32B of the second coil conductor piece 24*b*32 is placed, in a bent manner, at a position on the rectangular magnetic layer 22*b*3 which is near the second corner c2 but toward the center and away from the first end 24*b*31A of the first coil conductor piece 24*b*31. The remaining multiple sets of coil conductor pieces are also connected sequentially via through hole conductors in the same manner as explained above.

Also, among the multiple sets of coil conductor pieces, the set of coil conductor pieces closest to the bottom face 24*b*51, 24*b*52 is connected to the pair of terminal electrodes 25*a*, 25*b*, respectively, via the through hole conductors 24*d*51, 24*d*52, 24*d*61, 24*d*62, 24*d*71, 24*d*72, 24*d*81, 24*d*82 and other coil conductor pieces 24*b*61, 24*b*62, 24*b*71, 24*b*72, 24*b*81, 24*b*82.

Also under this embodiment, a cross-section area 24Sa of the magnetic path on the inner side of the folded conductor piece 24*a* is greater than a cross-section area 24Sb of the magnetic path on the inner side of the first set of coil conductor pieces closest to the folded conductor piece among the multiple sets of coil conductor pieces so as to provide high inductance, while increase in the conductor length of the folded conductor piece 24*a* is suppressed compared to the total conductor length of the first set of coil conductor pieces, and consequently a laminated inductor of low direct-current resistance (Rdc) and low power consumption can be provided.

Also under this embodiment, the first corner c1 of the laminate is positioned diagonally opposite the second corner c2. Accordingly, a laminated inductor requiring less directionality when mounting can be provided.

Also under this embodiment, the straight distance between the first through hole conductor and second through hole conductor can be increased, so a highly reliable laminated inductor can be provided by preventing short-circuiting between through hole conductors.

Figure 7:
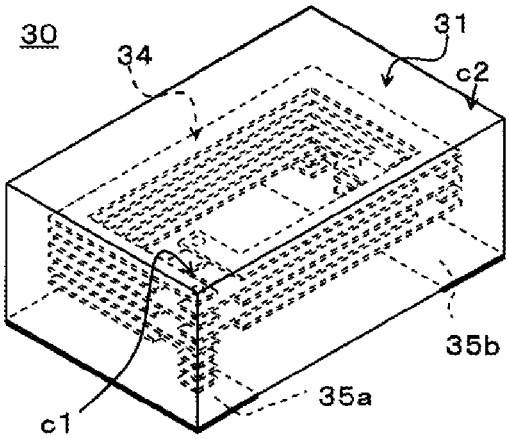
FIG. 7 is an oblique perspective view showing the internal structure of the third embodiment of the laminated inductor proposed by the present invention.
Figure 8:
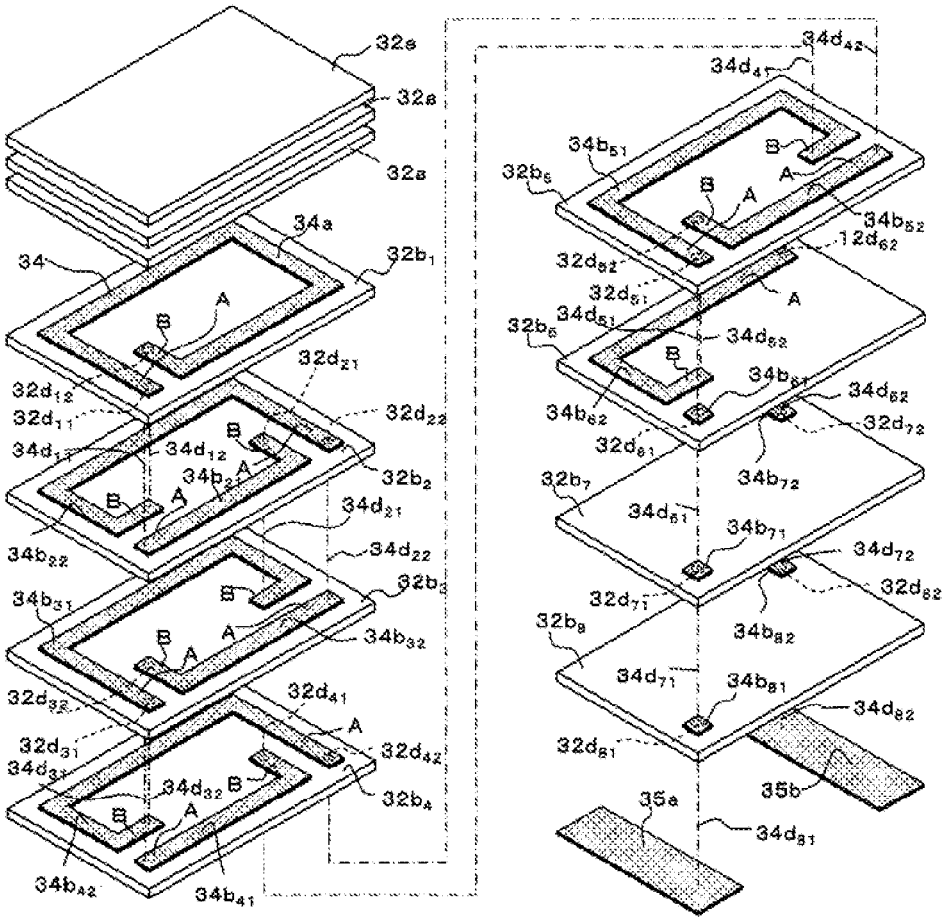
FIG. 8 is an exploded perspective view showing the internal structure of the laminated inductor according to the aforementioned embodiment.
Figure 9:
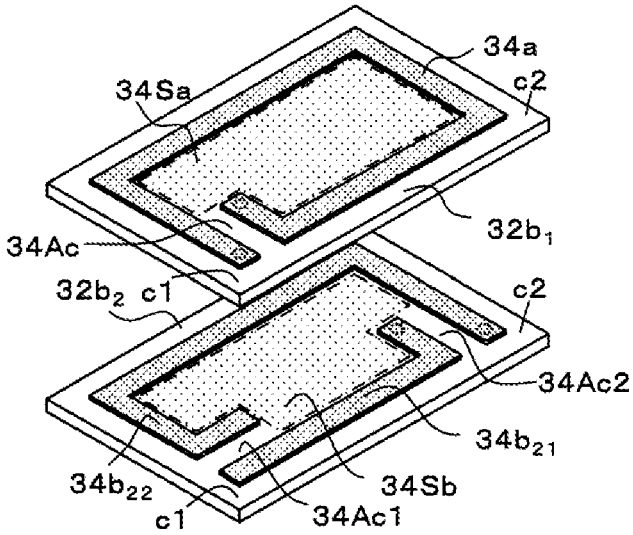
FIG. 9 is an exploded perspective view showing key parts, provided to explain the internal structure of the laminated inductor according to the aforementioned embodiment.

Next, the third embodiment of the laminated inductor proposed by the present invention is explained by referring to FIGS. 7 to 9. FIG. 7 is an oblique perspective view showing the internal structure of a laminated inductor 30 according to this embodiment. FIG. 8 is an exploded perspective view, provided to explain the internal structure of the laminated inductor 30. FIG. 9 is an exploded perspective view of key parts, provided to explain the internal structure of the laminated inductor 30.

The laminated inductor 30 according to this embodiment has:

a rectangular solid laminate 31 constituted by multiple rectangular magnetic layers 32*a*, 32*b* stacked in the thickness direction; and a pair of terminal electrodes 35*a*, 35*b* formed only on the bottom face of the laminate 31 excluding the top face, and areas near the top face on the end face and both side faces contacting the top face, of the laminate 31.

Also, a folded conductor piece 34*a* is placed on a first magnetic layer 32*b*1 inserted into the laminate 31 near the top face.

One of multiple sets of coil conductor pieces 34*b*21, 34*b*22; 34*b*31, 34*b*32; 34*b*41, 34*b*42; 34*b*51, 34*b*52 is placed on multiple magnetic layers 32*b*2, 32*b*3, 32*b*4, 32*b*5 between the first magnetic layer 32*b*1 in the laminate 31 and bottom face of the laminate 31, with the total of each set constituting around one turn worth of the rectangular windings.

Also, there are multiple through hole conductors 34*d*11, 34*d*12; 34*d*21, 34*d*22; 34*d*31, 34*d*32; 34*d*41, 34*d*42, each penetrating through at least one magnetic layer 32*b*1, 32*b*2, 32*b*3 or 32*b*4 in the laminate 31 and interconnecting the conductor pieces lying adjacently on both sides of this magnetic layer.

The folded conductor piece 34*a* constitutes around one turn worth of the rectangular windings along each side of the first magnetic layer 32*b*1, and has one end 34*a*A placed near any first corner c1 of the first magnetic layer 32*b*1, and the other end 34*a*B placed, in a bent manner, at a position on the first rectangular magnetic layer 32*b*1 which is near the first corner c1 but toward the center and away from the aforementioned one end 34*a*A so as not to overlap with the one end.

Also, among the multiple sets of coil conductor pieces 34*b*21, 34*b*22; 34*b*31, 34*b*32; 34*b*41, 34*b*42; 34*b*51, 34*b*52, the coil conductor pieces 34*b*21, 34*b*22 in the first set closest to the folded conductor piece are formed on the rectangular magnetic layer 32*b*2. The first coil conductor piece 34*b*21 has a first end 34*b*21A connected to the one end 34*a*A of the folded conductor piece 34*a* via the first through hole conductor 34*d*11 among the multiple through hole conductors placed near the first corner c1 of the laminate 31, and a second end 34*b*21B placed near any second corner c2 among the remaining three corners of the laminate 31. The second coil conductor piece 34*b*22 has a third end 34*b*22B connected to the other end 34*a*B of the folded conductor piece 34*a* via the second through hole conductor 34*d*12 among the multiple through hole conductors placed near the first corner c1 of the laminate 31, and a fourth end 34*b*22A placed near the second corner c2.

The second end 34*b*21B of the first coil conductor piece 34*b*21 is placed, in a bent manner, at a position on the rectangular magnetic layer 32*b*2 which is near the second corner c2 but toward the center and away from the fourth end 34*b*22A of the second coil conductor piece 34*b*22. The third end 34*b*22B of the second coil conductor piece 34*b*22 is placed, in a bent manner, at a position on the rectangular magnetic layer 32*b*2 which is near the first corner c1 but toward the center and away from the first end 34*b*21A of the first coil conductor piece 34*b*21.

Similarly, the second set of coil conductor pieces 34*b*31, 34*b*32 near the folded conductor piece is formed on the rectangular magnetic layer 32*b*3. The second coil conductor piece 34*b*32 has a first end 34*b*32A connected to the fourth end 34*b*22A of the second coil conductor piece 34*b*22 among the first set of coil conductor pieces via the through hole conductor 34*d*22 placed near the second corner c2 of the laminate 31, and a second end 34*b*32B placed near the first corner c1 among the remaining three corners of the laminate 31. The first coil conductor piece 34*b*31 has a third end 34*b*31B connected to the second end 34*b*21B of the first coil conductor piece 34*b*21 among the first set of coil conductor pieces via the through hole conductor 34*d*21 placed near the second corner c2 of the laminate 31, and a fourth end 34*b*31A placed near the first corner c1.

The third end 34*b*31B of the first coil conductor piece 34*b*31 is placed, in a bent manner, at a position on the rectangular magnetic layer 32*b*3 which is near the second corner c2 but toward the center and away from the first end 34*b*32A of the second coil conductor piece 34*b*32. The second end 34*b*32B of the second coil conductor piece 34*b*32 is placed, in a bent manner, at a position on the rectangular magnetic layer 32*b*3 which is near the first corner c1 but toward the center and away from the fourth end 34*b*31A of the first coil conductor piece 34*b*31. The remaining multiple sets of coil conductor pieces are also connected sequentially via through hole conductors in the same manner as explained above.

Also, among the multiple sets of coil conductor pieces, the set of coil conductor pieces closest to the bottom face 34*b*51, 34*b*52 is connected to the pair of terminal electrodes 35*a*, 35*b*, respectively, via the through hole conductors 34*d*51, 34*d*52, 34*d*61, 34*d*62, 34*d*71, 34*d*72, 34*d*81, 34*d*82 and other coil conductor pieces 34*b*61, 34*b*62, 34*b*71, 34*b*72, 34*b*81, 34*b*82.

Also under this embodiment, a cross-section area 34Sa of the magnetic path on the inner side of the folded conductor piece 34*a* is greater than a cross-section area 34Sb of the magnetic path on the inner side of the first set of coil conductor pieces closest to the folded conductor piece among the multiple sets of coil conductor pieces so as to provide high inductance, while increase in the conductor length of the folded conductor piece 34*a* is suppressed compared to the total conductor length of the first set of coil conductor pieces, and consequently a laminated inductor of low direct-current resistance (Rdc) and low power consumption can be provided.

Also under this embodiment, the first corner c1 of the laminate is positioned on the other end of the same long side as the second corner c2. Also under this embodiment, the first coil conductor piece and second coil conductor piece in the multiple sets of coil conductor pieces have their one end positioned near a corner of the laminate, with the other end positioned on the magnetic layer near another corner of the laminate but toward the center and away from the end of the other coil conductor piece.

Also under this embodiment, the straight distance between the first through hole conductor and second through hole conductor can be increased, so a highly reliable laminated inductor can be provided by preventing short-circuiting between through hole conductors.

Figure 10:
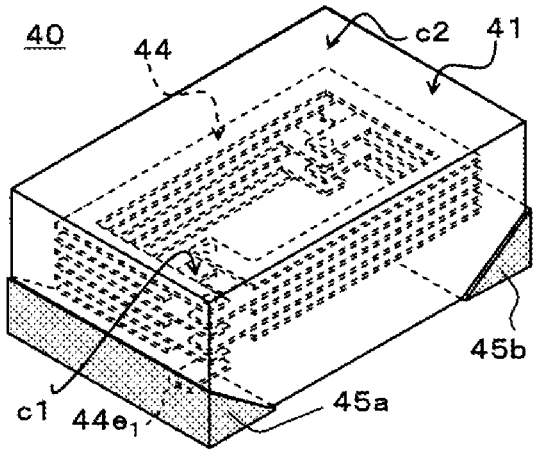
FIG. 10 is an oblique perspective view showing the internal structure of the fourth embodiment of the laminated inductor proposed by the present invention.
Figure 11:
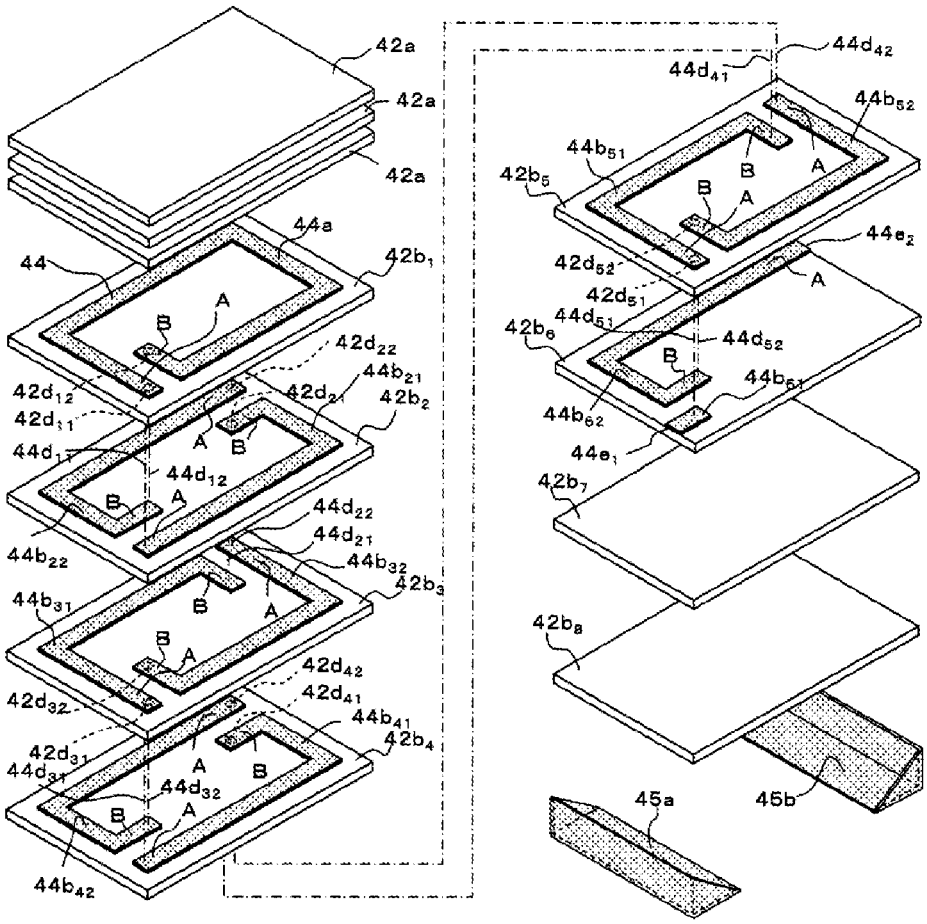
FIG. 11 is an exploded perspective view showing the internal structure of the laminated inductor according to the aforementioned embodiment.
Figure 12:
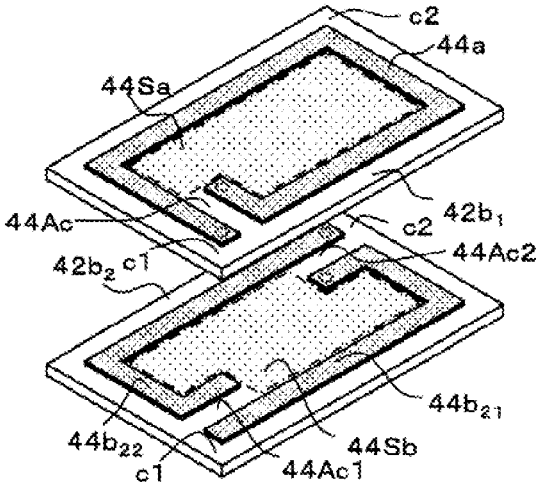
FIG. 12 is an exploded perspective view showing key parts, provided to explain the internal structure of the laminated inductor according to the aforementioned embodiment.

Next, the fourth embodiment of the laminated inductor proposed by the present invention is explained by referring to FIGS. 10 to 12. FIG. 10 is an oblique perspective view showing the internal structure of a laminated inductor 40 according to this embodiment. FIG. 11 is an exploded perspective view, provided to explain the internal structure of the laminated inductor 40. FIG. 12 is an exploded perspective view of key parts, provided to explain the internal structure of the laminated inductor 40.

The laminated inductor 40 according to this embodiment has:

a rectangular solid laminate 41 constituted by multiple rectangular magnetic layers 42*a*, 42*b* stacked in the thickness direction; and a pair of terminal electrodes 45*a*, 45*b* formed on the bottom face of the laminate 41 excluding the top face, and areas near the top face on the end face and both side faces contacting the top face, of the laminate 41, and also on areas near the bottom face on the end face and both side faces contacting the bottom face.

Also, a folded conductor piece 44*a* is placed on a first magnetic layer 42*b*1 inserted into the laminate 41 near the top face.

One of multiple sets of coil conductor pieces 44*b*21, 44*b*22; 44*b*31, 44*b*32; 44*b*41, 44*b*42; 44*b*51, 44*b*52 is placed on multiple magnetic layers 42*b*2, 42*b*3, 42*b*4, 42*b*5 between the first magnetic layer 42*b*1 in the laminate 41 and bottom face of the laminate 41, with the total of each set constituting around one turn worth of the rectangular windings.

Also, there are multiple through hole conductors 44*d*11, 44*d*12; 44*d*21, 44*d*22; 44*d*31, 44*d*32; 44*d*41, 44*d*42, each penetrating through at least one magnetic layer 42*b*1, 42*b*2, 42*b*3 or 42*b*4 in the laminate 41 and interconnecting the conductor pieces lying adjacently on both sides of this magnetic layer.

The folded conductor piece 44*a* constitutes around one turn worth of the rectangular windings along each side of the first magnetic layer 42*b*1, and has one end 44*a*A placed near any first corner c1 of the first magnetic layer 42*b*1, and the other end 44*a*B placed, in a bent manner, at a position on the first rectangular magnetic layer 42*b*1 which is near the first corner c1 but toward the center and away from the aforementioned one end 44*a*A so as not to overlap with the one end.

Also, among the multiple sets of coil conductor pieces 44*b*21, 44*b*22; 44*b*31, 44*b*32; 44*b*41, 44*b*42; 44*b*51, 44*b*52, the coil conductor pieces 44*b*21, 44*b*22 in the first set closest to the folded conductor piece is formed on the rectangular magnetic layer 42*b*2. The first coil conductor piece 44*b*21 has a first end 44*b*21A connected to the one end 44*a*A of the folded conductor piece 44*a* via the first through hole conductor 44*d*11 among the multiple through hole conductors placed near the first corner c1 of the laminate 41, and a second end 44*b*21B placed near any second corner c2 among the remaining three corners of the laminate 41. The second coil conductor piece 44*b*22 has a third end 44*b*22B connected to the other end 44*a*B of the folded conductor piece 44*a* via the second through hole conductor 44*d*12 among the multiple through hole conductors placed near the first corner c1 of the laminate 41, and a fourth end 44*b*22A placed near the second corner c2.

The second end 44*b*21B of the first coil conductor piece 44*b*21 is placed, in a bent manner, at a position on the rectangular magnetic layer 42*b*2 which is near the second corner c2 but away toward the center from the fourth end 44*b*22A of the second coil conductor piece 44*b*22. The third end 44*b*22B of the second coil conductor piece 44*b*22 is placed, in a bent manner, at a position on the rectangular magnetic layer 42*b*2 which is near the first corner c1 but toward the center and away from the first end 44*b*21A of the first coil conductor piece 44*b*21.

Similarly, the second set of coil conductor pieces 44*b*31, 44*b*32 near the folded conductor piece is formed on the rectangular magnetic layer 42*b*3. The second coil conductor piece 44*b*32 has a first end 44*b*32A connected to the fourth end 44*b*22A of the second coil conductor piece 44*b*22 among the first set of coil conductor pieces via the through hole conductor 44*d*22 placed near the second corner c2 of the laminate 41, and a second end 44*b*32B placed near the first corner c1 among the remaining three corners of the laminate 41. The first coil conductor piece 44*b*31 has a third end 44*b*31B connected to the second end 44*b*21B of the first coil conductor piece 44*b*21 among the first set of coil conductor pieces via the through hole conductor 44*d*21 placed near the second corner c2 of the laminate 41, and a fourth end 44*b*31A placed near the first corner c1.

The second end 44*b*32B of the second coil conductor piece 44*b*32 is placed, in a bent manner, at a position on the rectangular magnetic layer 42*b*3 which is near the first corner c1 but away toward the center from the fourth end 44*b*31A of the first coil conductor piece 44*b*31. The third end 44*b*31B of the first coil conductor piece 44*b*31 is placed, in a bent manner, at a position on the rectangular magnetic layer 42*b*3 which is near the second corner c2 but toward the center and away from the first end 44*b*32A of the second coil conductor piece 44*b*32. The remaining multiple sets of coil conductor pieces are also connected sequentially via through hole conductors in the same manner as explained above.

Also, among the multiple sets of coil conductor pieces, the set of coil conductor pieces closest to the bottom face 44*b*51, 44*b*52 is connected to the pair of terminal electrodes 45*a*, 45*b*, respectively, via the through hole conductors 44*d*51, 44*d*52 and leader parts 44*e*1, 44*e*2 of other coil conductor pieces 44*b*61, 44*b*62.

Also under this embodiment, a cross-section area 44Sa of the magnetic path on the inner side of the folded conductor piece 44*a* is greater than a cross-section area 44Sb of the magnetic path on the inner side of the first set of coil conductor pieces closest to the folded conductor piece among the multiple sets of coil conductor pieces so as to provide high inductance, while increase in the conductor length of the folded conductor piece 44*a* is suppressed compared to the total conductor length of the first set of coil conductor pieces, and consequently a laminated inductor of low direct-current resistance (Rdc) and low power consumption can be provided.

Also under this embodiment, the first coil conductor piece and second coil conductor piece in the multiple sets of coil conductor pieces have their one end positioned near a corner of the laminate, with the other end positioned, in a bent manner, on the magnetic layer near another corner of the laminate but toward the center an away from the end of the other coil conductor piece. This constitution reduces the bent part needed to keep the through hole conductor on the other end away from the through hole conductor on one end, and consequently the corresponding increase in conductor length can be suppressed. This way, a laminated inductor of low direct-current resistance (Rdc) and low power consumption can be provided. Also under this embodiment, the first corner c1 of the laminate is positioned diagonally opposite the second corner c2. Under this embodiment, the first coil conductor piece and second coil conductor piece in each set can have the same shape, to provide a laminated inductor that can be produced easily and requires less directionality when mounting.

Also under this embodiment, the first terminal electrode 45*a* electrically connected via a coil conductor to the one end of the folded conductor piece 44*a*, and second terminal electrode 45*b* electrically connected via a coil conductor to the other end of the folded conductor piece 44*a*, each have a wraparound part covering parts of both side faces and one end face contacting the bottom face of the laminate 41.

Also under this embodiment, the straight distance between the first through hole conductor and second through hole conductor can be increased, so a highly reliable laminated inductor can be provided by preventing short-circuiting between through hole conductors.

Next, the constitution of each part of the laminated inductor proposed by the present invention is explained.

The size of the laminated inductor can be set in any way. For example, the external dimensions may be length L=2.0 mm, width W=1.25 mm and thickness T=0.8 mm. For the magnetic layer, any material can be selected from among the various known magnetic materials according to the purpose. For example, Ni—Zn—Cu ferrite may be used. For the terminal electrodes, various conductor materials may be used. For example, a baking-type silver electrode material paste containing silver powder may be applied by means of screen printing, etc., and baked to form a base electrode layer, followed by sequential forming of a Ni plating layer and a solder plating layer. The coil conductor can also be formed using a silver electrode material paste in the same manner as explained above. The coil conductor size can also be set in a desired manner according to the purpose. For example, it can have a length of 1.4 mm and width of 0.8 mm, wound in a rough rectangular shape, and its line width set to 0.1 mm, for example.

Example 1

Next, an example of the laminated inductor proposed by the present invention is explained by referring to the aforementioned first embodiment (FIGS. 1 to 3).

First, ethyl cellulose and terpineol were added to a tentatively baked and crushed Ni—Zn—Cu ferrite fine powder whose main ingredients are $FeO_2$, CuO, ZnO and NiO, and the mixture was kneaded to create a slurry. This slurry was coated to a fixed thickness using the doctor blade method and then dried, after which the dried slurry was cut to the screen plate printing size described later to create a magnetic sheet. Through holes were made at specified positions in this magnetic sheet using die punching, laser drilling or other method. Next, the screen plate having a conductor piece shape constituting a part of the coil conductor was used to print a silver electrode material paste on the magnetic sheet and the printed paste was dried. Next, a number of the magnetic sheets were stacked on top of one another so that the conductor pieces on an adjacent pair of magnetic sheets would be interconnected via two through hole conductors including one at a corner of the coil, and the stacked sheets were pressure-bonded using a press. The pressed sheets were cut to a specified size and then heated for 1 hour at 500° C., after which the binder was removed and the obtained sheets were sintered for 2 hours in air at a temperature of 800 to 900° C., to obtain multiple laminates. A silver electrode material paste was printed or otherwise applied on the bottom face of the obtained laminate so as to connect the through hole conductors connected to the coil conductors, and then the paste was baked for 1 hour in air at approx. 600° C. to form a base layer for a pair of terminal electrodes. Ni barrel electroplating was applied to the surface of this base layer and then solder barrel electroplating was applied, and a pair of terminal electrodes were formed. Laminated inductor samples representing the example in FIGS. 1 to 3 were obtained through the aforementioned procedure.

The constitution of each key part of the laminated inductor sample representing the example, as obtained above, was as follows. Specifically, the external laminated inductor dimensions were length 2.0 mm×width 1.25 mm×height 0.8 mm. The magnetic layer was made of Ni—Zn—Cu ferrite. The external dimensions of the coil conductor 14 in a perspective top view of the laminate were length 1.4 mm×width 0.8 mm, where the total area of the coil conductor intersecting zones 14Ac1, 14Ac2 whose diagonal ends were defined by the first through hole conductor and second through hole conductor was 0.25 $mm^2$, while the through hole pitch was 0.35 mm. As for the constitution of each part of the coil conductor, as shown in FIG. 3 the coil conductor and intersecting zones were included in the external dimensions of the rectangle. The cross-section area 14Sa of the magnetic path on the inner side of the folded conductor piece 14*a* was 0.658 $mm^2$, while the cross-section area 14Sb of the magnetic path on the inner side of the first set of coil conductor pieces 14*b*21, 14*b*22 was 0.595 $mm^2$. When 10 laminated inductor samples representing the above example were measured for direct-current resistance (Rdc) using a milliohm meter 3227 made by HIOKI, the average was 322 mΩ. When the laminated inductor samples representing the above example were measured for inductance at a measurement frequency of 1 MHz using a LCR meter 4285A by Agilent, the average was 2.23 μH.

COMPARATIVE EXAMPLE

Figure 13:
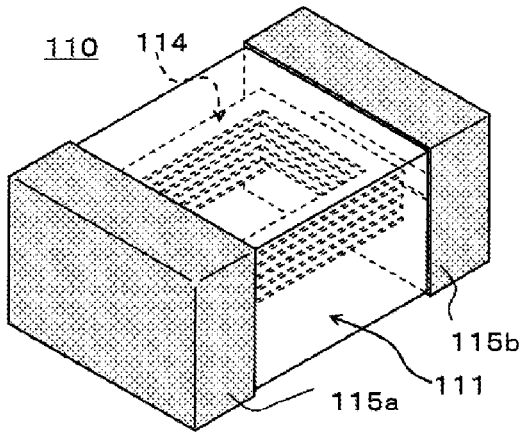
Fig. 13 Background Art
FIG. 13 is an oblique perspective view showing a part of the internal structure illustrating one example of a laminated inductor based on prior art.
Figure 14:
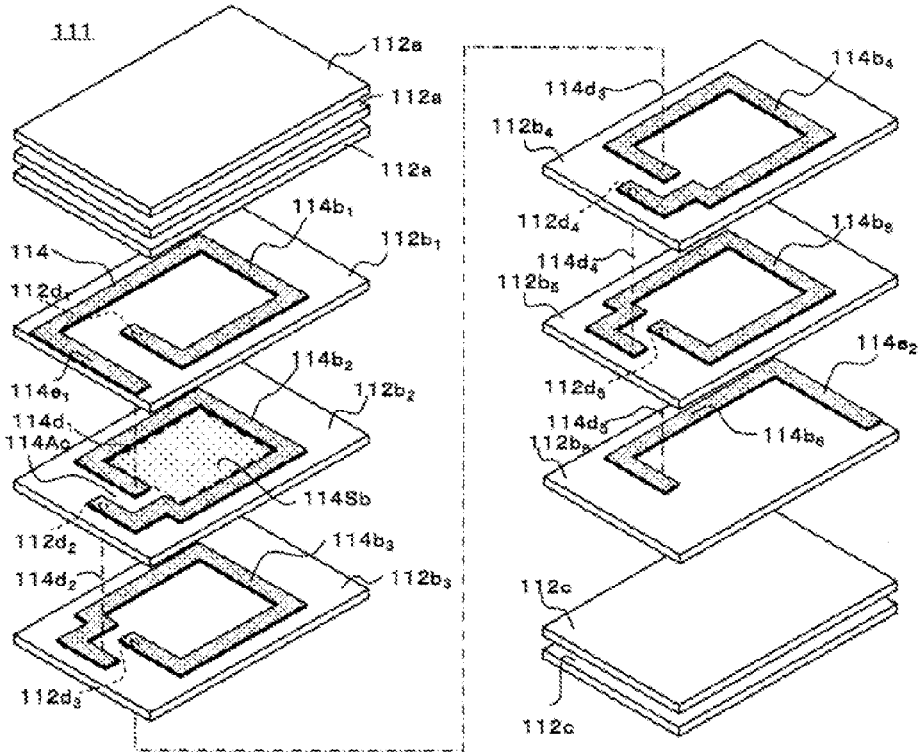
Fig. 14 Background Art
FIG. 14 is an exploded perspective view showing the internal structure of the laminate used for the aforementioned laminated inductor based on prior art.

In the same manner as in Example 1 above, laminated inductor samples representing the comparative example in FIGS. 13 and 14 were created based on external laminated inductor dimensions of length 2.0 mm×width 1.25 mm×height 0.8 mm, magnetic layer material of Ni—Zn—Cu ferrite, external conductor dimensions of length 1.4 mm×width 0.8 mm in a perspective top view of the laminate, area of coil conductor intersecting zone 114Ac of 0.25 $mm^2$, and pitch of adjacent through holes of 0.35 mm. As for the constitution of each part of the coil conductor, as shown in FIG. 14 the coil conductor and intersecting zone 114Ac were included in the external dimensions of the rectangle. The cross-section area 114Sb of the magnetic path on the inner side of the coil conductor (such as 114*b*2) was 0.535 $mm^2$. When 10 laminated inductor samples representing the above comparative example were measured for direct-current resistance (Rdc) in the same manner as in the above example, the average was 385 mΩ. When the laminated inductor samples representing the above comparative example were measured for inductance in the same manner as in the above example, the average was 1.96 pH.

The above results show that the laminated inductor in the example of the present invention provides higher inductance than the laminated inductor in the comparative example in FIGS. 13 and 14, while suppressing increase in direct-current resistance. The laminated inductor in the example of the present invention is also easy to mount in a metal shield of an electronic device.

(Example of Variation)

It should be noted that, although the laminated inductor in each embodiment above has multiple magnetic layers constituting the laminate, the present invention is not limited to the foregoing and, for example, a non-magnetic layer may be inserted between magnetic layers constituting the laminate, in a manner contacting the conductor piece constituting the coil conductor, to improve direct-current bias characteristics of the laminated inductor.

INDUSTRIAL FIELD OF APPLICATION

The present invention is suitable for a slim laminated inductor used as a choke coil in a power-supply circuit, etc., of an electronic device.

DESCRIPTION OF THE SYMBOLS

10, 20, 30, 40: Laminated inductor/11, 21, 31, 41: Laminate/12*a*, 12*b*, 22*a*, 22*b*, 32*a*, 32*b*, 42*a*, 42*b*: Magnetic layer/12*d*, 22*d*, 32*d*, 42*d*: Through hole/14, 24, 34, 44: Coil conductor/14*a*, 24*a*, 34*a*, 44*a*: Folded conductor piece/14*b*, 24*b*, 34*b*, 44*b*: Coil conductor piece/14*d*, 24*d*, 34*d*, 44*d*: Through hole conductor/15*a*, 15*b*, 25*a*, 25*b*, 35*a*, 35*b*, 45*a*, 45*b*: Terminal electrode/c1: First corner/c2: Second corner/14Sa, 24Sa, 34Sa, 44Sa: Cross-section area of the magnetic path on the inner side of the folded conductor piece/14Sb, 24Sb, 34Sb, 44Sb: Cross-section area of the magnetic path on the inner side of the first set of coil conductor pieces/14Ac, 14Ac1, 14Ac2, 24Ac, 24Ac1, 24Ac2, 34Ac, 34Ac1, 34Ac2, 44Ac, 44Ac1, 44Ac2: Intersecting zone

What is claimed is:

1. A laminated inductor comprising:

a rectangular solid laminate constituted by multiple rectangular magnetic layers stacked in a thickness direction;

a pair of terminal electrodes formed at least on a bottom face of the laminate excluding a top face, and areas near the top face on an end face and both side faces contacting the top face, of the laminate;

a folded conductor piece placed on a first magnetic layer inserted into the laminate near the top face;

multiple sets of coil conductor pieces where each set is placed on the multiple magnetic layers between the first magnetic layer in the laminate and bottom face of the laminate, with the total of each set constituting around one turn worth of windings; and multiple through hole conductors, each penetrating through at least one magnetic layer in the laminate and interconnecting the conductor pieces lying adjacently on both sides of this magnetic layer;

said laminated inductor characterized in that:

the folded conductor piece constitutes around one turn worth of windings along each side of the first magnetic layer, and has one end placed near any first corner of the first magnetic layer, and the other end placed at a position on the first rectangular magnetic layer which is near the first corner but toward a center and away from the one end so as not to overlap with the one end;

among the multiple sets of coil conductor pieces, coil conductor pieces in a first set closest to the folded conductor piece comprise: a first coil conductor piece having a first end connected to the one end of the folded conductor piece via a first through hole conductor among the multiple through hole conductors placed near the first corner of the laminate, and a second end placed near any second corner among remaining three corners of the laminate; and a second coil conductor piece having a third end connected to the other end of the folded conductor piece via a second through hole conductor among the multiple through hole conductors placed at a position on the rectangular magnetic layer which is near the first corner of the laminate but toward a center and away from the first end, and a fourth end placed near the second corner;

any one of the second end of the first coil conductor piece and fourth end of the second coil conductor piece is placed at a position on the rectangular magnetic layer which is near the second corner but toward a center and away from the end of the other coil conductor piece; and among the multiple sets of coil conductor pieces, a set of coil conductor pieces closest to the bottom face is connected to the pair of terminal electrodes via through hole conductors and other coil conductor pieces, respectively.

2. A laminated inductor according to claim 1, characterized in that a cross-section area of a magnetic path on an inner side of the folded conductor piece is greater than a cross-section area of a magnetic path on an inner side of the first set of coil conductor pieces closest to the folded conductor piece among the multiple sets of coil conductor pieces.

3. A laminated inductor according to claim 1, characterized in that the second corner of the laminate is positioned diagonally opposite the first corner.

4. A laminated inductor according to claim 1, characterized in that the first terminal electrode electrically connected via a coil conductor to the one end of the folded conductor piece, and the second terminal electrode electrically connected via a coil conductor to the other end of the folded conductor piece, are each formed only on the bottom face of the laminate.

5. A laminated inductor according to claim 1, characterized in that the first terminal electrode and second terminal electrode each have a wraparound part covering parts of both side faces and one end face contacting the bottom face of the laminate.

* * * * *